US009538841B2

(12) United States Patent
Franck et al.

(10) Patent No.: US 9,538,841 B2
(45) Date of Patent: Jan. 10, 2017

(54) VERSATILE RACKS AND RELATED ASSEMBLIES AND METHODS

(71) Applicant: WirePath Home Systems, LLC, Charlotte, NC (US)

(72) Inventors: Christopher Glenn Franck, Fort Mill, SC (US); William Jacob Kozlowski, Jr., Waxhaw, NC (US); Jamie Lee Quinlan, Charlotte, NC (US)

(73) Assignee: Wirepath Home Systems, LLC, Charlotte, NC (US)

( * ) Notice: Subject to any disclaimer, the term of this patent is extended or adjusted under 35 U.S.C. 154(b) by 84 days.

(21) Appl. No.: 14/454,889

(22) Filed: Aug. 8, 2014

(65) Prior Publication Data

US 2016/0037913 A1 Feb. 11, 2016

(51) Int. Cl.

| | |
|---|---|
| ***A47B 55/00*** | (2006.01) |
| ***A47B 46/00*** | (2006.01) |
| ***A47B 47/00*** | (2006.01) |
| ***A47B 57/08*** | (2006.01) |
| ***A47B 43/00*** | (2006.01) |
| ***A47B 57/20*** | (2006.01) |
| ***A47B 57/10*** | (2006.01) |

(52) U.S. Cl.

CPC ..... *A47B 55/00* (2013.01); *A47B 43/00* (2013.01); *A47B 46/00* (2013.01); *A47B 57/10* (2013.01); *A47B 57/20* (2013.01)

(58) Field of Classification Search

CPC ..... A47B 46/00; A47B 43/00; A47B 43/04; A47B 57/20; A47B 45/00; A47B 57/10; A47B 55/00; A47F 5/10

USPC ..... 211/195, 201

See application file for complete search history.

(56) References Cited

U.S. PATENT DOCUMENTS

| | | | | | |
|---|---|---|---|---|---|
| 1,255,407 | A * | 2/1918 | Goetz | A47B 43/04 | 312/114 |
| 1,727,048 | A * | 9/1929 | Cady | A47B 43/00 | 108/115 |
| 2,252,570 | A * | 8/1941 | Knuth | A47B 57/20 | 211/135 |
| 2,415,825 | A * | 2/1947 | Knuth | A47B 57/20 | 108/147.16 |
| D158,876 | S | 6/1950 | Lowell | | |
| 2,679,321 | A * | 5/1954 | Koeferl | B65B 27/083 | 100/1 |
| 3,463,265 | A * | 8/1969 | Clover | E04G 1/34 | 182/119 |
| 3,508,666 | A * | 4/1970 | Schwengel | A47B 45/00 | 182/186.6 |
| 3,533,502 | A * | 10/1970 | Hansen | A47B 45/00 | 206/386 |
| 3,967,327 | A * | 7/1976 | Severson | A47C 19/20 | 108/176 |
| 4,354,331 | A * | 10/1982 | Dyke | A47B 3/0916 | 52/66 |

(Continued)

*Primary Examiner* — Stanton L Krycinski

(74) *Attorney, Agent, or Firm* — Myers Bigel, P.A.

(57) ABSTRACT

A rack includes a base resting on a horizontal surface, a top and four elongated legs. Each leg includes a bottom portion pivotally connected to the base and a top portion pivotally connected to the top. The rack is movable between a flat position, wherein the legs are substantially parallel to the horizontal surface, and an upright position, wherein the legs are substantially perpendicular to the horizontal surface.

20 Claims, 8 Drawing Sheets

(56) References Cited

U.S. PATENT DOCUMENTS 4,548,012 A * 10/1985 Dyer ..... A47B 43/00 52/646
4,858,726 A * 8/1989 Preston ..... E04G 1/34 182/112
5,090,725 A * 2/1992 Feldner ..... B62B 3/02 211/189
D326,198 S 5/1992 Pacetti et al.
5,197,393 A * 3/1993 Yeakle ..... A47B 9/10 108/10
5,242,255 A * 9/1993 Gleffe ..... B65D 19/12 108/53.1
5,439,152 A * 8/1995 Campbell ..... B60R 9/00 108/55.1
D362,102 S 9/1995 Campbell et al.
D429,916 S 8/2000 Hurd
6,145,447 A * 11/2000 Henderson ..... B60R 5/04 108/115
6,270,281 B1 * 8/2001 Ruusuvuori ..... H05K 7/1425 211/182
D515,847 S 2/2006 Moon et al.
D618,419 S 6/2010 Catron et al.
D625,125 S 10/2010 Buckles et al.
7,854,444 B2 * 12/2010 Zhuang ..... B62B 3/02 280/651
D661,141 S 6/2012 Bao
8,297,450 B2 10/2012 Zavidniak et al.
8,342,544 B1 * 1/2013 Blewett ..... B62B 3/022 211/189
D703,466 S 4/2014 Franck et al.
8,869,995 B2 * 10/2014 Masse ..... H05K 5/0217 211/195
2008/0217276 A1 * 9/2008 Brady ..... B65D 19/12 211/195
2015/0173508 A1 * 6/2015 Ma ..... H05K 7/1488 211/208

* cited by examiner

VERSATILE RACKS AND RELATED ASSEMBLIES AND METHODS

BACKGROUND

Many racks are sold and/or shipped in an unassembled state and then assembled where the rack is to be used. The assembly can be complex and require tools. After assembly, the rack may have limited versatility with regard to the configuration of the assembled rack.

It is desirable to provide a rack that can be shipped or stored in a flat configuration and easily manipulated to an upright position for use. It is also desirable for such a rack to be sturdy in the upright position even if the rack is "assembled" without tools. It is still further desirable for the rack to be versatile not only in the movement between the flat and upright positions, but also to be adaptable to different configurations in the upright position.

SUMMARY

Some embodiments of the present invention are directed to a rack. The rack includes a base resting on a horizontal surface, a top and four elongated legs. Each leg includes a bottom portion pivotally connected to the base and a top portion pivotally connected to the top. The rack is movable between a flat position, with the legs are substantially parallel to the horizontal surface, and an upright position, with the legs are substantially perpendicular to the horizontal surface.

In some embodiments, the base and the top are substantially parallel to the horizontal surface in each of the flat and the upright positions.

In some embodiments, the rack includes a plurality of fasteners configured to lock the rack in the upright position. The plurality of fasteners may be thumb screws. The bottom portion of each leg may be pivotally connected to a corresponding support member of the base and the top portion of each leg may be pivotally connected to a corresponding support member of the top. In the upright position, an aperture at the bottom portion of each leg may be aligned with an aperture of the corresponding support member of the base and an aperture at the top portion of each leg may be aligned with an aperture of the corresponding support member of the top. In the upright position, one of the fasteners may be received through the aligned apertures at the bottom portion of each leg and the corresponding support member of the base and another one of the fasteners may be received through the aligned apertures at the top portion of each leg and the corresponding support member of the top.

In some embodiments, in the upright position, each leg includes a plurality of shelf mounting features at different vertical positions relative to the horizontal surface, with the rack further including a shelf releasably mounted between the legs and substantially parallel to the horizontal surface at a selected vertical position using the shelf mounting features. The plurality of shelf mounting features may include a column of spaced apart apertures in each leg. The shelf may include a plurality of pins with one of the pins received in one of the apertures of each leg. The plurality of pins may include first and second pins. The first pin may be operatively connected to a first button on the shelf with the first pin configured to retract into the shelf responsive to actuation of the first button. The second pin may be operatively connected to a second button on the shelf with the second pin configured to retract into the shelf responsive to actuation of the second button.

In some embodiments, each leg includes a lower leg member and an upper leg member that is movable relative to the lower leg member such that the rack is adjustable in height in the upright position. The upper leg member may be slidably received in the lower leg member. The lower leg member may include an aperture and the upper leg member may include a column of spaced apart apertures that can be selectively aligned with the aperture of the lower leg member. The rack may include a locking member that extends through the selectively aligned apertures to lock the rack in a selected extended position.

In some embodiments, the rack includes equipment mounting features on outer surfaces of two of the legs. The equipment mounting features may be provided in spaced apart groups of two mounting features with the two mounting features in a respective group spaced apart a distance such that 1 rack unit (1 U) equipment can be mounted thereto. The equipment mounting features may be provided in spaced apart groups of two mounting features such that one of the mounting features of one group and one of the mounting features of an adjacent group are spaced apart a distance such that 2 rack unit (2 U) equipment can be mounted thereto.

Some other embodiments of the present invention are directed to a rack. The rack includes a base resting on a horizontal surface, a top and four elongated legs. Each leg includes a bottom portion pivotally connected to the base and a top portion pivotally connected to the top. The rack is movable between a flat position, wherein the legs are substantially parallel to the horizontal surface, and an upright position, wherein the legs are substantially perpendicular to the horizontal surface. The rack is lockable in the upright position. The rack is extendable from the upright position to a plurality of different selectable extended positions. The rack is lockable in the selected extended position.

In some embodiments, the rack includes a plurality of shelf mounting features at various selectable heights relative to the horizontal surface. The rack may include one or more shelves releasably mounted to the rack between the legs at one or more selected heights.

In some embodiments, in the flat position, the rack has a height of between about 4.5 and 6.5 inches and, in the upright position, the rack has a height of between about 22 and 24 inches. In some embodiments, in the flat position, the rack has a height of between about 4.5 and 6.5 inches and, in the upright position, the rack has a height of between about 36 and 38 inches.

Some other embodiments of the present invention are directed to a method including providing a rack. The rack includes a base resting on a horizontal surface, a top and four elongated legs, with each leg including a bottom portion pivotally connected to the base and a top portion pivotally connected to the top. The method includes rotating the rack from a flat position, wherein the legs are substantially parallel to the horizontal surface and the base and the top are substantially parallel to the horizontal surface, to an upright position, wherein the legs are substantially perpendicular to the horizontal surface and the base and the top are substantially parallel to the horizontal surface.

In some embodiments, the method includes locking the rack in the upright position using a thumb screw that extends through each leg and the base and a thumb screw that extends through each leg and the top.

Some other embodiments of the present invention are directed to a shelf configured to be releasably mounted to a rack. The shelf includes a shelf body, first and second fixed pins on a first side of the shelf body, first and second retractable pins on a second, opposite side of the shelf body and at least one actuator. The at least one actuator is operatively connected to the first and second retractable pins, and the first and second retractable pins are configured to retract into the shelf body responsive to actuation of the at least one actuator.

DETAILED DESCRIPTION OF EMBODIMENTS OF THE INVENTION

Figure 1:
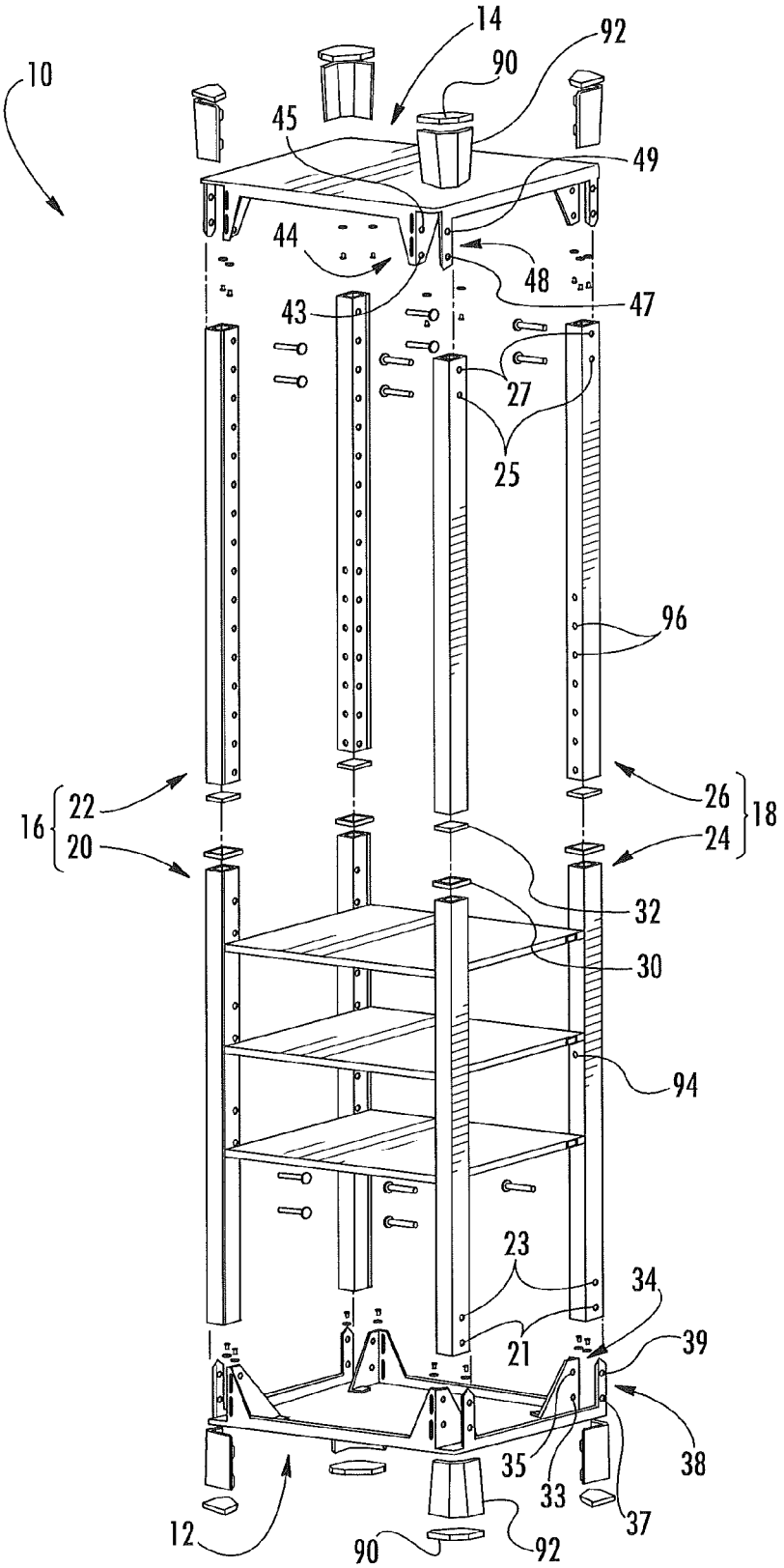
FIG. 1 is an exploded perspective view of a rack according to some embodiments of the invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
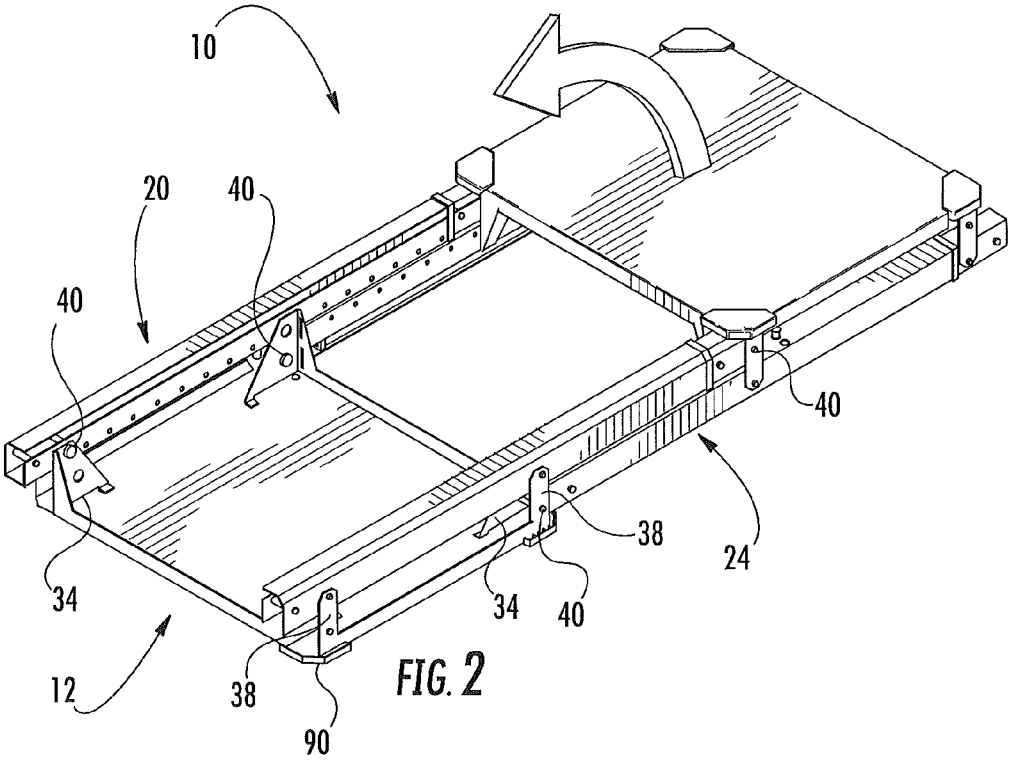
FIG. 2 is a front perspective view of the rack of FIG. 1 in a flat position.
Figure 3:
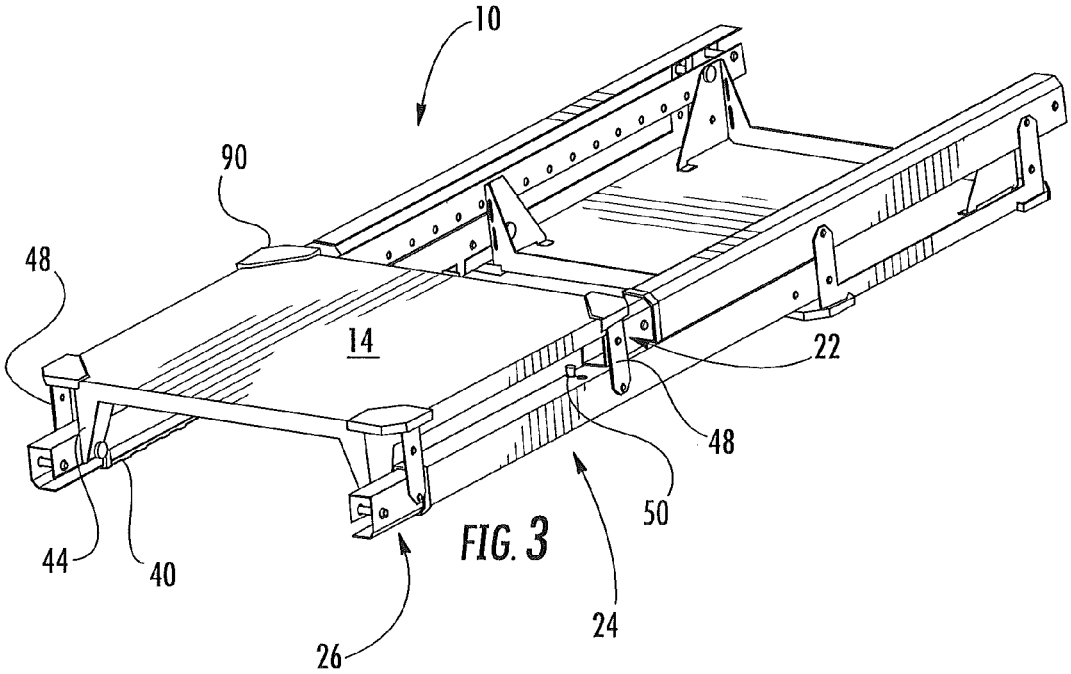
FIG. 3 is a rear perspective view of the rack of FIG. 1 in the flat position.
Figure 4:
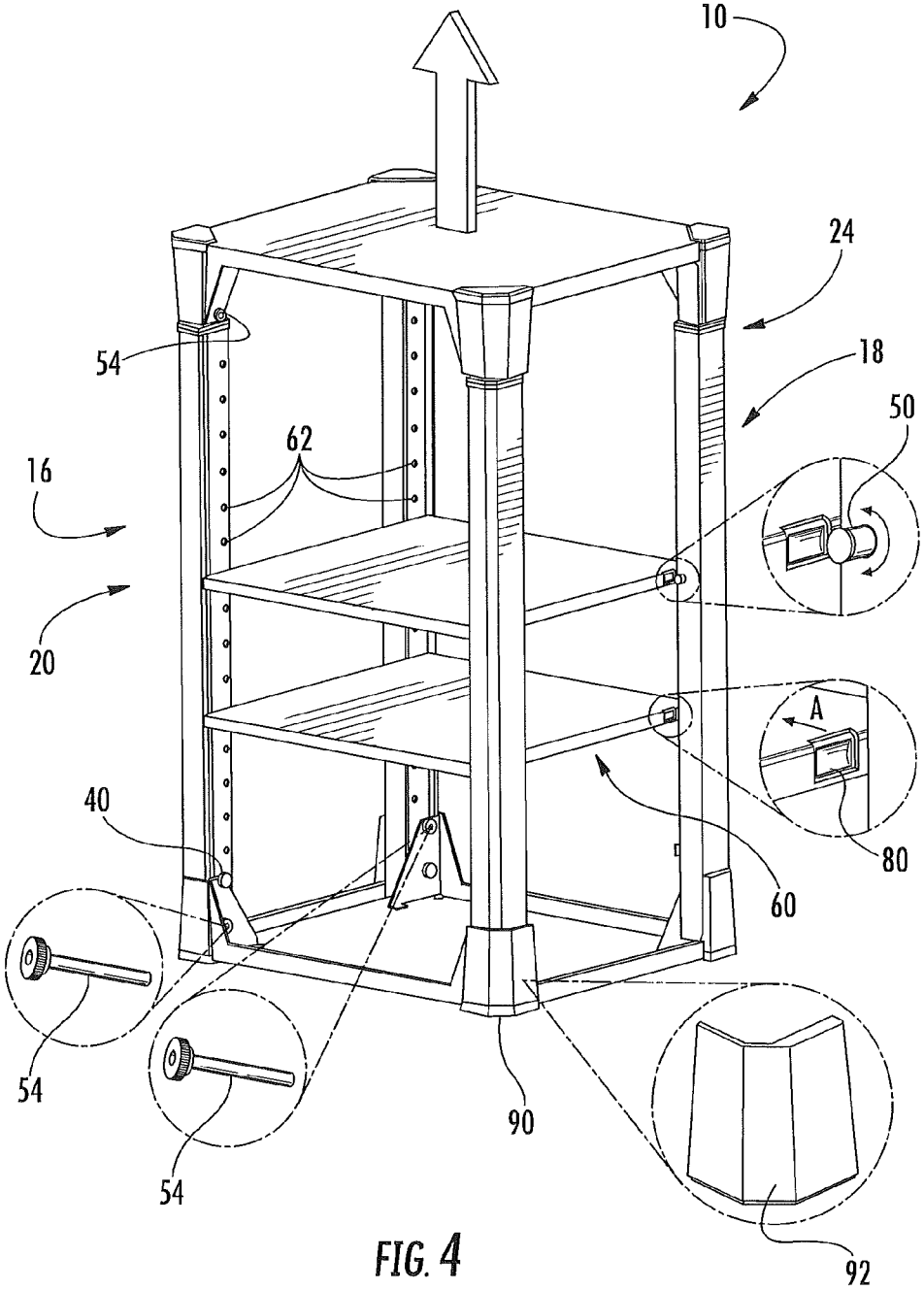
FIG. 4 is a front perspective view of the rack of FIG. 1 in an upright position with shelf assemblies releasably held in the rack.
Figure 5:
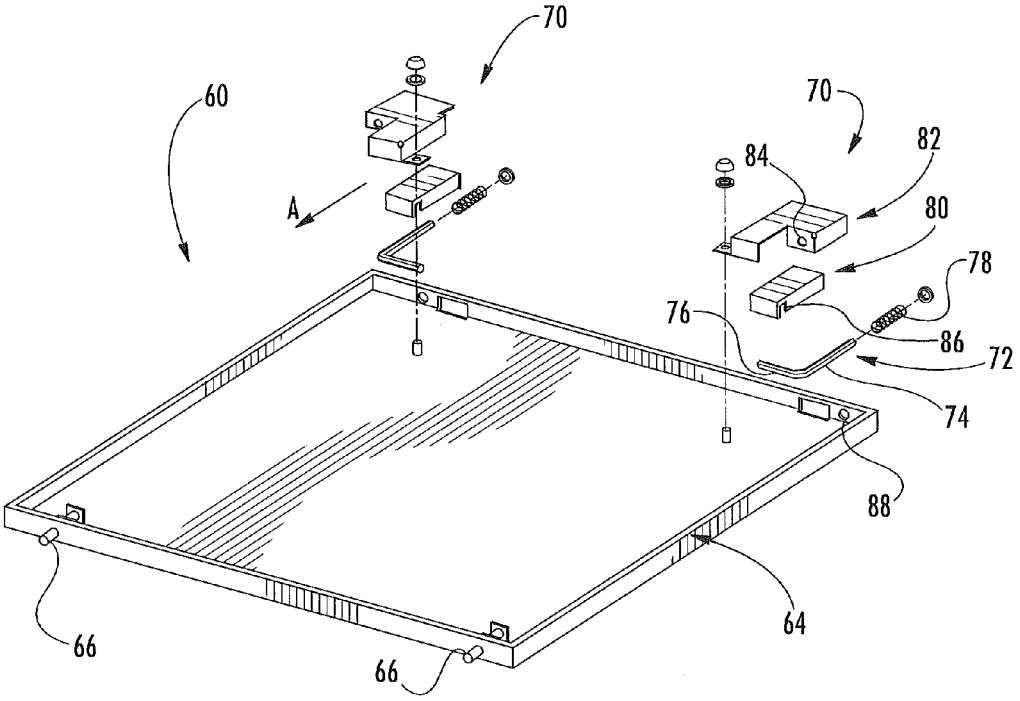
FIG. 5 is an exploded perspective view of one of the shelf assemblies of FIG. 4.
Figure 6:
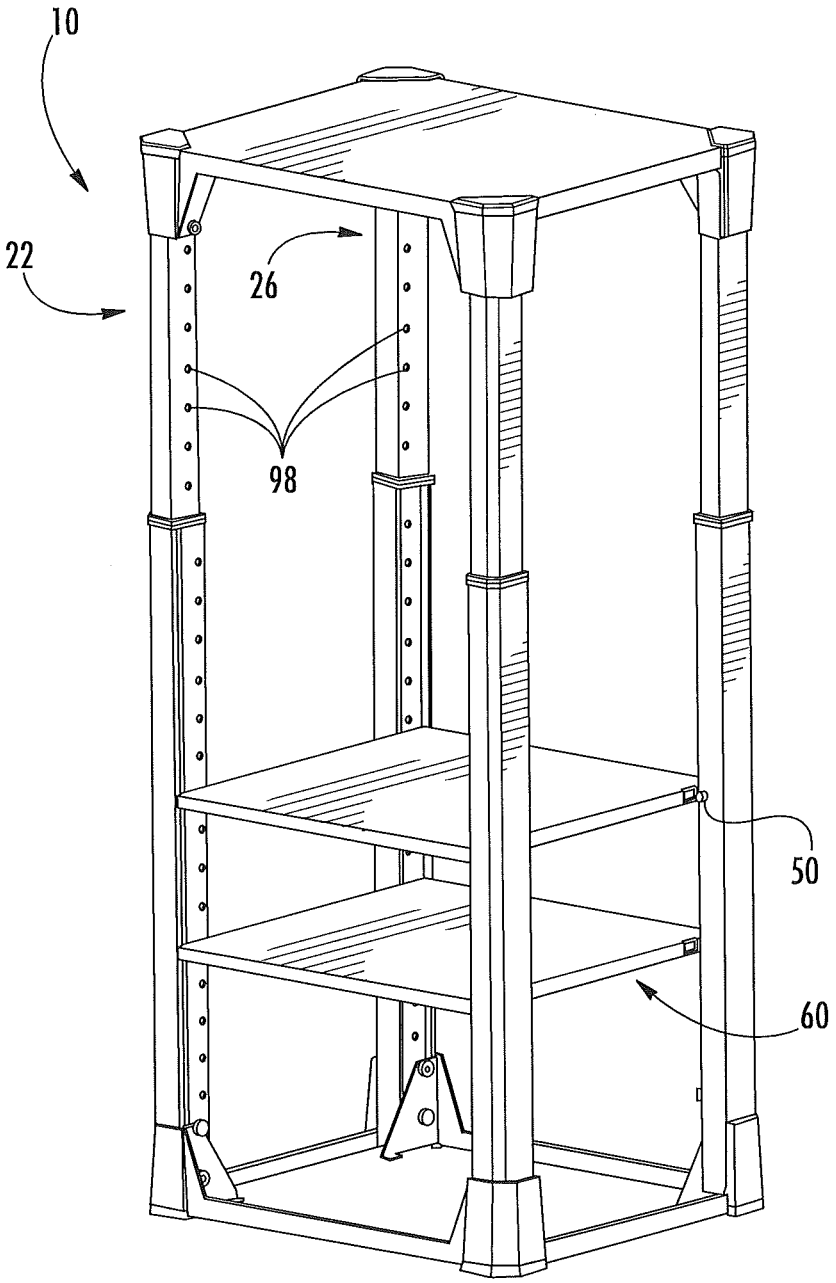
FIG. 6 is a front perspective view of the rack of FIG. 1 in an extended position.

A rack or rack assembly 10 according to some embodiments is shown in FIGS. 1-11. As will be described in more detail below, the rack 10 is configured to be rotated between a flat position (FIGS. 2 and 3) and an upright position (FIG. 4). In some embodiments, in the upright position, the rack 10 is configured to be extended to one or more extended positions (FIG. 6).

Referring to FIG. 1, the rack 10 includes a base 12 and a top 14. The base 12 and the top 14 may be metal or polymeric. A suitable material for the base 12 and the top 14 is steel.

The rack 10 includes two front legs 16 and two back or rear legs 18. Each one of the legs 16, 18 is pivotally connected to the base 12 and the top 14. The legs 16, 18 may be metal or polymeric. A suitable material for the legs 16, 18 is steel.

As illustrated, each front leg 16 includes a lower leg member 20 and an upper leg member 22. The upper leg member 22 may be slidably received in the lower leg member 20. Similarly, each rear leg 18 includes a lower leg member 24 and an upper leg member 26. The upper leg member 26 may be slidably received in the lower leg member 24. It will be understood that other telescopic leg configurations are contemplated.

Each of the lower leg members 20, 24 may include an outer leg glider 30 at a top of the lower leg member. Each of the upper leg members 22, 26 may include an inner leg glider 32 at a bottom of the upper leg member. The outer leg gliders 30 may engage an outer surface of the upper leg members 22, 26 as they slide within the lower leg members 20, 24. The inner leg gliders 32 may engage an inner surface of the lower leg members 20, 24 as the upper leg members 22, 26 slide therein. The leg gliders 30, 32 have smooth surfaces for reduced friction as the legs slide relative to one another. The leg gliders 30, 32 may be formed of a relatively low-friction polymeric material; an exemplary suitable material is polyethylene.

As seen in FIG. 2, each corner of the base 12 includes an inner support member 34 and an outer support member 38 between which a lower portion of a respective one of the lower leg members 20, 24 is received. As described in more detail below, pivot member 40 (e.g., a pivot pin or other fastener) extends through aligned apertures of the support members 34, 38 and the lower leg member. In this way, the legs 16, 18 are pivotally connected to the base 12.

In some embodiments, and referring to FIGS. 1 and 2, a bottom portion of each of the lower leg members 20, 24 includes a lower aperture or passageway 21 and an upper aperture or passageway 23. Each of the inner support members 34 of the base 12 includes a lower aperture 33 and an upper aperture 35. Each of the outer support members 38 of the base 12 includes a lower aperture 37 and an upper aperture 39. The front legs 16 are pivotally connected to the base 12 by the pivot member 40 that extends through the upper aperture 35 of the inner support member 34, the upper aperture 23 of the lower leg member 20 and the upper aperture 39 of the outer support member 38. The rear legs 18 are pivotally connected to the base 12 by the pivot member 40 that extends through the lower aperture 33 of the inner support member 34, the lower aperture 21 of the lower leg member 24 and the lower aperture 37 of the outer support member 38.

Similarly, as shown in FIG. 3, each corner of the top 14 includes an inner support member 44 and an outer support member 48 between which an upper portion of a respective one of the upper leg members 22, 26 is received. As described in more detail below, a pivot member 40 (e.g., a pivot pin or other fastener) extends through aligned apertures of the support members 44, 48 and the upper leg member. In this way, the legs 16, 18 are pivotally connected to the top 14.

In some embodiments, and referring to FIGS. 1-3, a top portion of each of the upper leg members 22, 26 includes a lower aperture or passageway 25 and an upper aperture or passageway 27. Each of the inner support members 44 of the top 14 includes a lower aperture 43 and an upper aperture 45. Each of the outer support members 48 of the top 14 includes a lower aperture 47 and an upper aperture 49. The front legs 16 are pivotally connected to the top 14 by the pivot member 40 that extends through the upper aperture 45 of the inner support member 44, the upper aperture 27 of the upper leg member 22 and the upper aperture 49 of the outer support member 48. The rear legs 18 are pivotally connected to the top 14 by the pivot member 40 that extends through the lower aperture 43 of the inner support member 44, the lower aperture 25 of the upper leg member 26 and the lower aperture 47 of the outer support member 48.

An upper leg member and a corresponding lower leg member may be releasably locked to one another using a locking member. For example, as shown in FIG. 3, the lower leg member 24 and the upper leg member 26 are releasably locked by locking member 50.

As shown by the arrow in FIG. 2, the rack 10 may be rotated from the flat position to an upright position as shown in FIG. 4. A user may grasp the top 14 and pull in the direction of the arrow such that the front and rear legs 16, 18 are upright or vertical. The rack 10 may self-balance in the upright position due to the general symmetry of the rack 10 in the upright position as well as the flat bottom profile of the legs 16, 18 and the flat upper surface of the base 12.

Still referring to FIG. 4, fasteners 54 are installed to lock the rack 10 in the upright position. The fasteners 54 may be installed in eight locations adjacent the pivot members 40 using the previously described apertures or passageways in the legs 16, 18, the inner and outer support members 34, 38 of the base 12 and the inner and outer support members 44, 48 of the top 14. In some embodiments, the fasteners 54 are thumb screws that can be hand tightened by the user. Once the fasteners 54 are installed, the rack 10 is sturdy and configured to hold objects and/or have objects mounted thereto, as will be described in more detail below.

As shown in FIG. 4, at least one shelf or shelf assembly 60 may be releasably installed and held in the rack 10. A column of a plurality of apertures 62 are formed in each of the legs 16, 18. As illustrated, the apertures 62 are formed in each one of the lower leg members 20, 24. The apertures 62 are configured to receive pins of the shelf assembly 60 as described below.

Turning to FIG. 5, the shelf assembly 60 includes a body 64. At one side of the body 64 are a pair of fixed or stationary pins 66. When the shelf 60 is installed in the rack 10, one of the pins 66 is received in one of the apertures 62 of one of the legs 16, 18 (or one of the lower leg members 20, 24) and the other one of the pins 66 is received in one of the apertures 62 of the another one of the legs 16, 18 (or the another one of the lower leg members 20, 24).

The shelf assembly 60 includes a pair of retractable pin assemblies 70 at a side of the shelf body 64 opposite the stationary pins 66. The retractable pin assembly 70 includes a retractable pin 72. The retractable pin 72 is generally L-shaped and includes first and second legs 74, 76. A biasing member such as a spring 78 extends around at least a portion of the first leg 74. The assembly 70 also includes an actuator such as a button 80 and an actuator cover such as a button cover 82. The button cover 82 includes an aperture or passageway 84. The button 80 includes a slot 86.

As assembled, the button 80 is at least partially received in the button cover 82. The first leg 74 of the retractable pin 72 extends through the aperture 84 of the button cover 82 and through the button 80. The second leg 76 of the retractable pin 72 is received in the slot 86 of the button 80. The spring 78 biases the retractable pin 72 out of and away from the shelf body 64. Specifically, the retractable pin first leg 74 extends out of an aperture 88 formed in the body 64.

The button 80 and the button cover 82 are shaped, sized and configured such that, when depressed, the button 80 can translate a limited distance in the direction A within the button cover 82 and into the shelf body 64 (FIGS. 4 and 5). This causes the retractable pin 72 to retract into the shelf body 64. Specifically, the retractable pin first leg 74 retracts fully or substantially fully into the shelf body 64.

A user can position and mount the shelves 60 as follows. The user may tilt or otherwise manipulate the shelf 60 so that it fits between the legs 16, 18. The stationary pins 66 may be positioned and received in apertures 62 in one of the front legs 16 and one of the rear legs 18. The user may depress the buttons 80 and level or otherwise align the shelf 60, then release the buttons 80 such that the retractable pins 72 are received in apertures 62 in the other one of the front legs 16 and the other one of the rear legs 18. In this configuration the shelf 60 is mounted (e.g., releasably mounted) in the rack 10.

As shown, shelves 60 can be mounted in a plurality of different locations due to the plurality of apertures 62 in the legs 16, 18.

When installed, the shelves 60 are configured to hold equipment or other objects. The shelves 60 may be metal or polymeric. A suitable material for the shelf 60 (or the shelf body 64) is steel.

It is contemplated that only one actuator or button could be used to retract the spring-loaded retractable pins 72. For example, the second legs 76 of the retractable pins 72 could be elongated and extend into a centrally located button and button cover (i.e., a button and button cover located between the buttons 80 and button covers 82 shown in FIG. 5). In this way, both pins 72 could retract into the shelf body 64 responsive to actuation of the single button.

Referring to FIGS. 1 and 4, corner bumpers 90 may be attached or connected to corners of the base 12 and the top 14. The corner bumpers 90 may have a flat outer surface and may be formed of a relatively low-friction polymeric material (e.g., polyethylene) to facilitate sliding or otherwise moving the rack 10 into a desired location or position. The corner bumpers 90 may also help prevent damage to a floor and/or damage due to inadvertent contact with objects such as walls. As shown in FIGS. 2 and 3, the corner bumpers 90 may be pre-installed on the base 12 and/or the top 14 (e.g., the rack 10 may be shipped with the corner bumpers 90 on the base 12 and/or the top 14).

Referring again to FIGS. 1 and 4, corner covers 92 may be optionally installed adjacent the corner bumpers 90. As shown, the corner covers 92 may be attached or connected to lower and upper portions of the legs 16, 18. The corner covers 92 may be formed of a polymeric material (e.g., polyethylene). The corner covers 92 may be used to provide a more finished appearance and/or to help prevent damage due to inadvertent contact with objects such as walls.

In some embodiments, and as shown by the arrow in FIG. 4, the rack 10 may be extended from the upright position shown in FIG. 4 to the extended position shown in FIG. 6. Referring to FIG. 1, each rear lower leg member 24 includes an aperture or passageway 94 formed in an inner surface thereof. Although not visible, each front lower leg member 20 also includes an aperture or passageway 94 formed in an inner surface thereof that is vertically aligned with (i.e., at the same height as) the aperture 94 of the rear lower leg member 24. Each rear upper leg member 26 includes a column of a plurality of apertures 96 in an inner surface thereof. Although not visible, each front upper leg members 22 also includes a column of a plurality of apertures 96 in an inner surface thereof, with respective ones of the apertures 96 of the front upper leg member 22 vertically aligned with (i.e., at the same height as) respective ones of the apertures 96 of the of the rear upper leg member 26.

As noted earlier, a locking member 50 may be used to lockingly engage one of the lower leg members with its corresponding upper leg member. For example, in the upright position shown in FIG. 4, a locking member 50 extends through the aperture 94 of each of the lower leg members 20, 24 and through the uppermost aperture 96 of the corresponding one of the upper leg members 22, 26.

Each locking member 50 may releasably lock one of the lower leg members with its corresponding upper leg member. For example, the locking members 50 may be rotatable lock pins (e.g., quarter-turn lock pins) that can be rotated or turned such that they extend out of the apertures 94, 96. The rack 10 can then be extended to a plurality of extended positions by, for example, pulling the top 14 upward such that the aperture 94 of each lower leg member aligns with another one of the apertures 96 of its corresponding upper leg member. The rack 10 may be "fully" extended by aligning the aperture 94 of each lower leg member with the lowermost aperture 96 of its corresponding upper leg member. The rack 10 may be locked in a desired extended position by reinserting and/or rotating or turning the locking members 50 in the opposite direction.

As shown in FIG. 6, an inner surface of each of the upper leg members 22, 26 includes a column of a plurality of vertically aligned apertures 98. These apertures 98 allow for the selective mounting of shelf assemblies 60 at desired locations (see, for example, FIG. 8).

Figure 7:
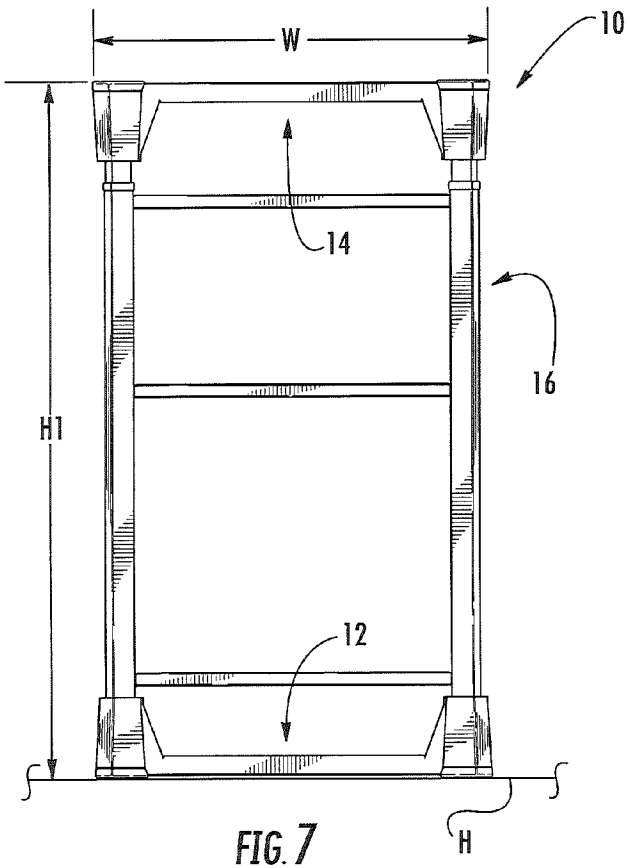
FIG. 7 is a front view of the rack of FIG. 1 in the upright position.
Figure 10:
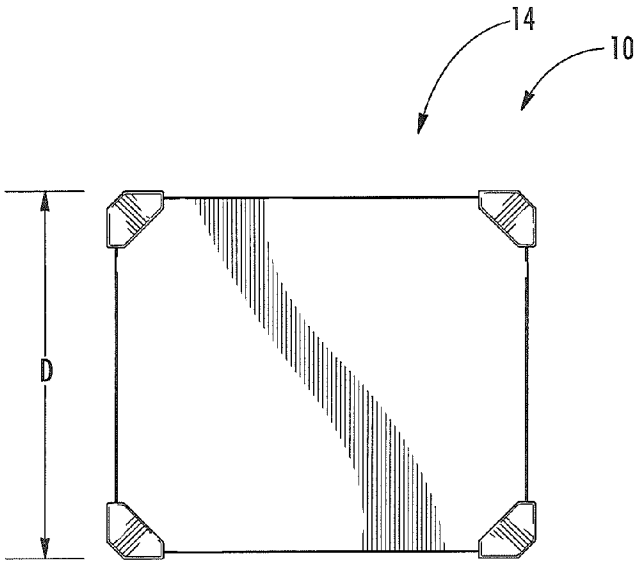
FIG. 10 is a top view of the rack of FIG. 1 in the upright position.

Referring now to FIG. 7, the rack 10 has a width W. The width W may be between about 19 and 25 inches and, in some embodiments, is between about 21 and 23 inches. The rack 10 in the upright position has a height H1. In some embodiments, the height H1 may be between about 20 and 26 inches or between about 22 and 24 inches. In some other embodiments, the height H1 may be between about 34 and 40 inches or between about 36 and 38 inches. Referring to FIG. 10, the rack 10 has a depth D. The depth D may be between about 15.5 and 21.5 inches and, in some embodiments, is between about 17.5 and 19.5 inches.

Figure 9:
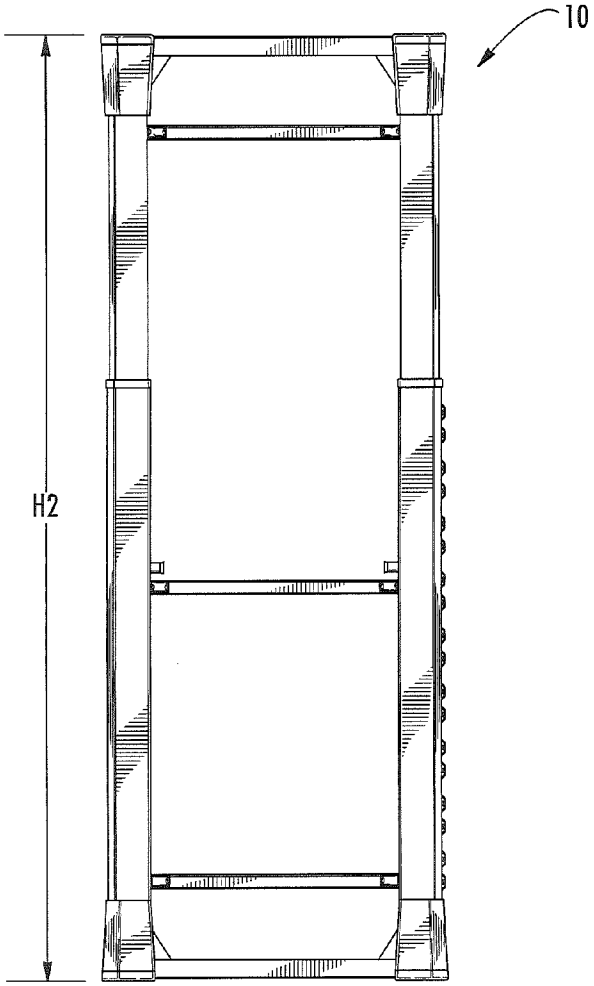
FIG. 9 is a side view of the rack of FIG. 1 in the extended position.

FIG. 9 illustrates the rack 10 in its fully extended position. The rack 10 has a height H2 in the fully extended position. In some embodiments, the height H2 is between about 28.5 and 34.5 inches or between about 30.5 and 32.5 inches. In some other embodiments, the height H2 is between about 48 and 54 inches or between about 50 and 52 inches.

Figure 11:
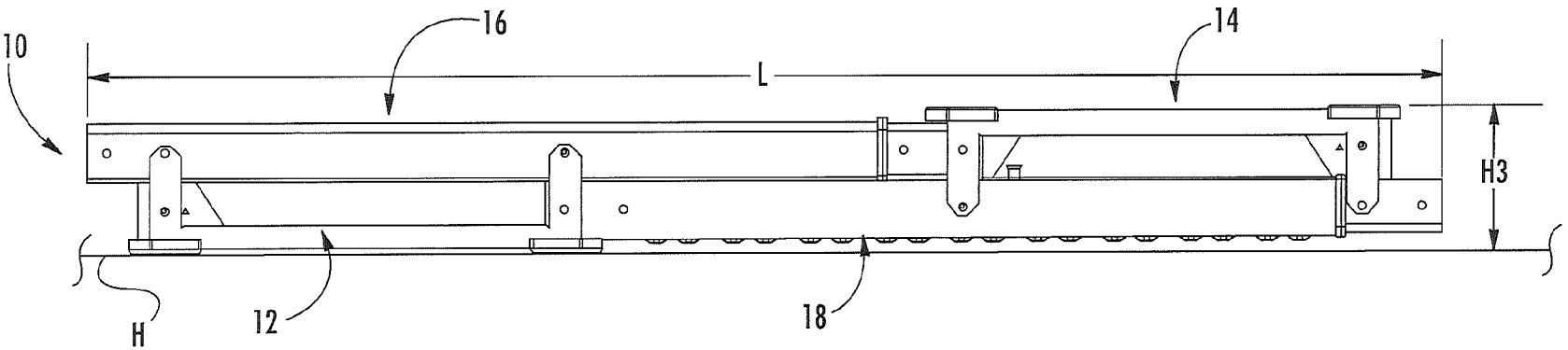
FIG. 11 is a side view of the rack of FIG. 1 in the flat position.

FIG. 11 illustrates the rack 10 in its flat position. The rack has a length L and a height H3 in the flat position. The height H3 may be between about 3.5 and 7.5 inches and, in some embodiments, is between about 4.5 and 6.5 inches or between about 5 and 6 inches. In some embodiments, the length L is between about 37 and about 43 inches or between about 39 and 41 inches. In some other embodiments, the length L is between about 45 and 51 inches or between about 47 and 49 inches. In some further embodiments, the length L is between about 50 and 56 inches or between about 52 and 54 inches. In still further embodiments, the length L is between about 64 and 70 inches or between about 66 and 68 inches.

The rack 10 may have different dimensions than those described above. In some embodiments, the rack 10 is configured as a computing or an audio/video (AV) rack. In such embodiments, the dimensions described above with the smaller heights H1, H2 and length L may provide a rack that is a 10 Rack Unit (10 U) rack in the upright position and a 15 U rack in the extended position. Further, the dimensions described above with the larger heights H1, H2 and length L may provide a rack that is a 16 U rack in the upright position and a 24 U rack in the extended position.

Figure 8:
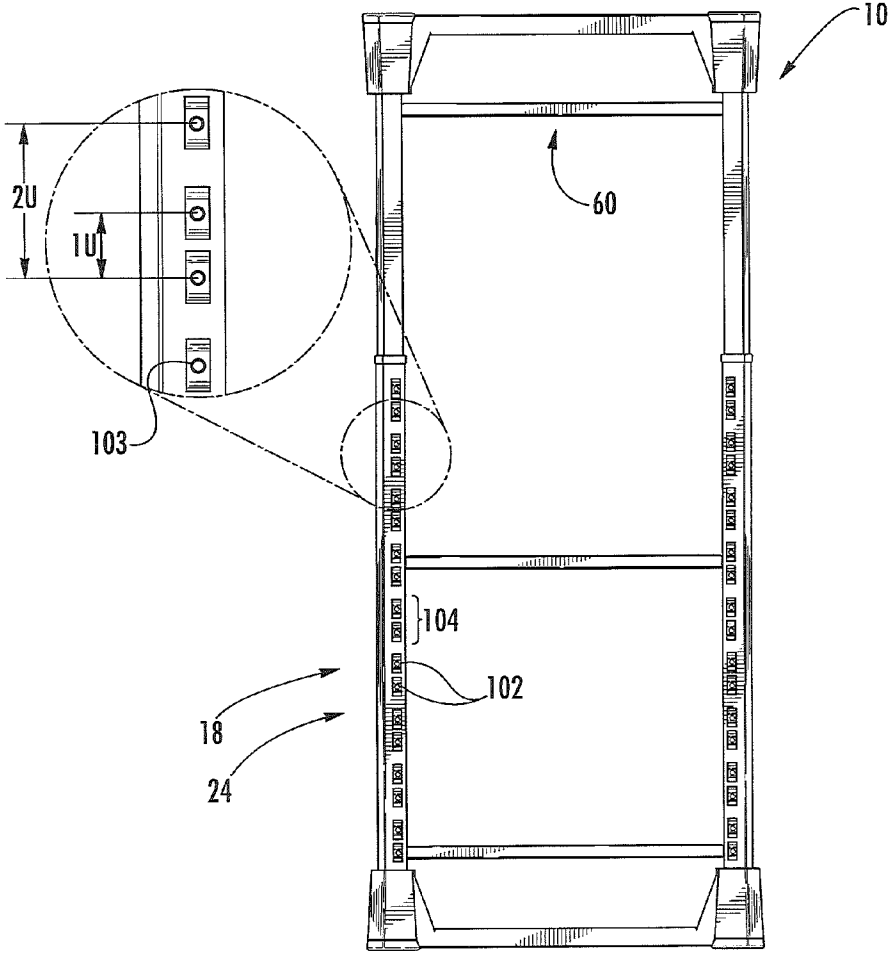
FIG. 8 is a rear view of the rack of FIG. 1 in the extended position.

In some embodiments, and referring to FIG. 8, outward facing surfaces of the rear legs 18 (or the rear lower leg members 24) may include a column of a plurality of mounting features 102 for mounting equipment. Each mounting feature 102 may include an aperture 103 such as a threaded aperture. The mounting features 102 may be arranged in spaced apart groups 104 of two mounting features 102.

The mounting features 102 are configured such that rack-mounted equipment such as AV equipment may be mounted thereto. As shown in FIG. 8, the mounting features 102 in a given group 104 may be spaced apart a distance suitable for mounting 1 U equipment (i.e., spaced apart about 1.75 inches). Also as shown, the mounting features 102 are positioned and configured such that 2 U equipment can be mounted to the rack 10. For example, the lowermost (or uppermost) mounting feature 102 of one group 104 and the lowermost (or uppermost) mounting feature 102 of an adjacent group 104 may be spaced apart a distance suitable for mounting 2 U equipment (i.e., spaced apart about 3.5 inches).

In some embodiments, the rack 10 is compliant with the Electronic Industries Association Standard EIA-310-D. For example, the horizontal and vertical spacing of the mounting features 102 as well as other dimensions of the rack 10 meet the requirements of EIA-310-D.

The rack 10, whether in its flat or upright position, can be easily flipped or otherwise manipulated if rack-mounted equipment is preferred to be on the top, bottom, rear or front of the rack 10.

As discussed above, the rack 10 can be easily manipulated from the flat position (FIGS. 2 and 3) to the upright position (FIG. 4) and to the extended position (FIG. 6). The rack can also be easily manipulated in the reverse order as will be understood in view of the description above. For example, the rack 10 can be returned to the flat position when moving the rack to another location or for storage.

Although in some embodiments the rack 10 is useful as a computing or AV rack, the rack 10 can also be used for other applications, such as for holding or storing items in closets, garages, workshops and so forth.

The rack 10 described above is sturdy and is capable of holding relatively heavy equipment or items on the shelves 60 and/or receiving relatively heavy rack-mounted equipment using the mounting features 102. In some embodiments, the rack 10 has a load capacity of up to 400 pounds.

As described above, embodiments of the invention provide a versatile rack assembly that allows a user to manipulate the rack from the flat position as shipped or stored to the upright position and then secure the rack in the upright position. Embodiments of the invention provide a rack that allows a user to extend and retract the rack to select from a plurality of available rack heights and then secure the rack at the desired height. Embodiments of the invention provide a rack that allows a user to releasably mount one or more shelves at a plurality of available vertical locations. The rack can be broken down to the flat position for shipping or storage. All of these operations can be performed without the use of tools.

With reference to FIGS. 7 and 11, in some embodiments, the base 12 rests on a horizontal surface H, such as a floor, in both the flat and upright positions. In the flat position, the legs 16, 18 are parallel, generally parallel or substantially parallel to the horizontal surface H. In the upright position, the legs 16, 18 are perpendicular, generally perpendicular or substantially perpendicular to the horizontal surface H. In both the flat and upright positions, the base 12 and the top 14 may be parallel, generally parallel or substantially parallel to the horizontal surface H.

In some embodiments, the rack 10 does not include extendable or telescopic legs. For example, the legs 16, 18 may not include upper and lower members. Instead, each leg 16, 18 may be a single member that is pivotally connected to the base 12 and the top 14. In such embodiments, the rack 10 may still have the dimensions described above. For example, even though not extendable, the legs 16, 18 may have lengths such that the rack has a height of H1 or H2 in the upright position.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A rack comprising:

a base resting on a horizontal surface, the base comprising first and second front support members and first and second rear support members, each support member comprising a lower aperture and an upper aperture;

a top; and four elongated legs comprising first and second front legs and first and second rear legs, each leg including a bottom portion pivotally connected to the base and a top portion pivotally connected to the top, each leg comprising a lower aperture and an upper aperture at the bottom portion thereof;

wherein the first and second front legs are pivotally connected to the first and second front support members, respectively, by pivot members that extend through the upper apertures of the front legs and the front support members, and wherein the first and second rear legs are pivotally connected to the first and second rear support members, respectively, by pivot members that extend through the lower apertures of the rear legs and the rear support members;

wherein the rack is movable between a flat position, wherein the legs are substantially parallel to the horizontal surface, and an upright position, wherein the legs are substantially perpendicular to the horizontal surface.

2. The rack of claim 1 wherein the base and the top are substantially parallel to the horizontal surface in each of the flat and the upright positions.

3. The rack of claim 1 further comprising a plurality of fasteners configured to lock the rack in the upright position.

4. The rack of claim 3 wherein:

the top portion of each leg is pivotally connected to a corresponding support member of the top;

in the upright position, an aperture at the top portion of each leg is aligned with an aperture of the corresponding support member of the top;

in the upright position, (i) the lower apertures at the bottom portion of the first and second front legs are aligned with the lower apertures of the corresponding first and second front support members, respectively, and (ii) the upper apertures at the bottom portion of the first and second rear legs are aligned with the upper apertures of the corresponding first and second rear support members, respectively; and in the upright position, one of the fasteners is received through the aligned apertures at the bottom portion of each leg and the corresponding support member of the base and another one of the fasteners is received through the aligned apertures at the top portion of each leg and the corresponding support member of the top.

5. The rack of claim 3 wherein the fasteners are thumb screws.

6. The rack of claim 1 wherein, in the upright position, each leg comprises a plurality of shelf mounting features at different vertical positions relative to the horizontal surface, the rack further comprising a shelf releasably mounted between the legs and substantially parallel to the horizontal surface at a selected vertical position using the shelf mounting features.

7. The rack of claim 6 wherein the plurality of shelf mounting features comprises a column of spaced apart apertures in each leg, wherein the shelf comprises a plurality of pins with one of the pins received in one of the apertures of each leg.

8. The rack of claim 7 wherein the plurality of pins comprises first and second pins, the first pin operatively connected to a first button on the shelf with the first pin configured to retract into the shelf responsive to actuation of the first button, the second pin operatively connected to a second button on the shelf with the second pin configured to retract into the shelf responsive to actuation of the second button.

9. The rack of claim 1 wherein each leg comprises a lower leg member and an upper leg member that is movable relative to the lower leg member such that the rack is adjustable in height in the upright position.

10. The rack of claim 9 wherein the upper leg member is slidably received in the lower leg member.

11. The rack of claim 9 wherein the lower leg member comprises an aperture and wherein the upper leg member comprises a column of spaced apart apertures that can be selectively aligned with the aperture of the lower leg member, the rack further comprising a locking member that extends through the selectively aligned apertures to lock the rack in a selected extended position.

12. The rack of claim 1 further comprising equipment mounting features on outer surfaces of two of the legs, wherein:

the equipment mounting features are provided in spaced apart groups of two mounting features with the two mounting features in a respective group spaced apart a distance such that 1 rack unit (1U) equipment can be mounted thereto;

the equipment mounting features are provided in the spaced apart groups of two mounting features such that one of the mounting features of one group and one of the mounting features of an adjacent group are spaced apart a distance such that 2 rack unit (2U) equipment can be mounted thereto.

13. A rack comprising:

a base resting on a horizontal surface, the base comprising first and second front support members and first and second back su sort members;

a top;

four elongated legs comprising first and second front legs and first and second back legs, each leg including a bottom portion pivotally connected to the base and a top portion pivotally connected to the top; and first through fourth fasteners;

wherein:

the rack is movable between a flat position, wherein the legs are substantially parallel to the horizontal surface, and an upright position, wherein the legs are substantially perpendicular to the horizontal surface;

the rack is lockable in the upright position;

the rack is extendable from the upright position to a plurality of different selectable extended positions; and the rack is lockable in the selected extended position;

wherein the first and second front legs are pivotally connected to the base by first and second pivot members that extend through the bottom portion of the first and second front legs and the first and second front support members, respectively, and wherein the first and second back legs are pivotally connected to the base by third and fourth pivot members that extend through the bottom portion of the first and second back legs and the first and second back support members, respectively;

wherein the rack is lockable in the upright position (i) by receiving the first fastener through aligned apertures of the first front leg and the first front support member that are below the first pivot member; (ii) by receiving the second fastener through aligned apertures of the second front leg and the second front support member that are below the second pivot member, (iii) by receiving the third fastener through aligned apertures of the first back leg and the first back support member that are above the third pivot member, and (iv) by receiving the fourth fastener through aligned apertures of the second back leg and the second back support member that are above the fourth pivot member.

14. The rack of claim 13 wherein the rack includes a plurality of shelf mounting features at various selectable heights relative to the horizontal surface, the rack further comprising one or more shelves releasably mounted to the rack between the legs at one or more selected heights.

15. The rack of claim 13 wherein, in the flat position, the rack has a height of between about 4.5 and 6.5 inches and, in the upright position, the rack has a height of between about 22 and 24 inches.

16. The rack of claim 13 wherein, in the flat position, the rack has a height of between about 4.5 and 6.5 inches and, in the upright position, the rack has a height of between about 36 and 38 inches.

17. The rack of claim 13 wherein the base and the top are substantially parallel to the horizontal surface in each of the flat and the upright positions.

18. The rack of claim 13 wherein the first through fourth fasteners are thumb screws.

19. The rack of claim 13 wherein each leg comprises a lower leg member and an upper leg member that is movable relative to the lower leg member such that the rack is adjustable in height in the upright position.

20. A rack comprising:

a base resting on a horizontal surface, the base comprising first and second front support members and first and second rear support members;

a top;

four elongated legs comprising first and second front legs and first and second rear legs, each leg including a bottom portion pivotally connected to the base and a top portion pivotally connected to the top; and first through fourth fasteners;

wherein:

the rack is movable between a flat position, wherein the legs are substantially parallel to the horizontal surface, and an upright position, wherein the legs are substantially perpendicular to the horizontal surface;

the rack is lockable in the upright position;

the first and second front legs are pivotally connected to the base by first and second pivot members that extend through the bottom portion of the first and second front legs and the first and second front support members, respectively, and wherein the first and second back legs are pivotally connected to the base by third and fourth pivot members that extend through the bottom portion of the first and second back legs and the first and second back support members, respectively;

the rack is lockable in the upright position (i) by receiving the first fastener through aligned apertures of the first front leg and the first front support member that are below the first pivot member; (ii) by receiving the second fastener through aligned apertures of the second front leg and the second front support member that are below the second pivot member, (iii) by receiving the third fastener through aligned apertures of the first back leg and the first back support member that are above the third pivot member, and (iv) by receiving the fourth fastener through aligned apertures of the second back leg and the second back support member that are above the fourth pivot member.

* * * * *